US008626501B2

(12) United States Patent
Toguri et al.

(10) Patent No.: US 8,626,501 B2
(45) Date of Patent: Jan. 7, 2014

(54) ENCODING APPARATUS, ENCODING METHOD, DECODING APPARATUS, DECODING METHOD, AND PROGRAM

(75) Inventors: Yasuhiro Toguri, Kanagawa (JP); Jun Matsumoto, Kanagawa (JP); Yuuji Maeda, Tokyo (JP); Shiro Suzuki, Kanagawa (JP); Yuuki Matsumura, Saitama (JP)

(73) Assignee: Sony Corporation, Tokyo (JP)

( * ) Notice: Subject to any disclaimer, the term of this patent is extended or adjusted under 35 U.S.C. 154(b) by 195 days.

(21) Appl. No.: 13/303,443

(22) Filed: Nov. 23, 2011

(65) Prior Publication Data

US 2012/0143614 A1 Jun. 7, 2012

(30) Foreign Application Priority Data

Dec. 3, 2010 (JP) ..... P2010-270544

(51) Int. Cl.
*G10L 21/00* (2013.01)

(52) U.S. Cl.
USPC ..... 704/226; 704/200; 704/200.1; 704/500

(58) Field of Classification Search
USPC ..... 704/200–201, 224–228, 500–502
See application file for complete search history.

(56) References Cited

U.S. PATENT DOCUMENTS

| | | | | |
|---|---|---|---|---|
| 6,862,567 | B1 * | 3/2005 | Gao | 704/228 |
| 7,191,121 | B2 * | 3/2007 | Liljeryd et al. | 704/219 |
| 7,395,211 | B2 * | 7/2008 | Watson et al. | 704/500 |
| 7,693,710 | B2 * | 4/2010 | Jelinek et al. | 704/207 |
| 7,912,712 | B2 * | 3/2011 | Shlomot et al. | 704/226 |
| 2007/0094009 | A1 * | 4/2007 | Ryu et al. | 704/200.1 |
| 2007/0239462 | A1 * | 10/2007 | Makinen et al. | 704/500 |
| 2009/0141790 | A1 * | 6/2009 | Kawashima et al. | 375/240 |
| 2010/0324917 | A1 * | 12/2010 | Shlomot et al. | 704/501 |

FOREIGN PATENT DOCUMENTS

| | | |
|---|---|---|
| JP | 9-294077 | 11/1997 |
| JP | 2731514 | 12/1997 |
| JP | 2003-5798 | 1/2003 |
| JP | 3463592 | 8/2003 |

* cited by examiner

*Primary Examiner* — Douglas Godbold
(74) *Attorney, Agent, or Firm* — Sherr & Jiang, PLLC

(57) ABSTRACT

An encoding apparatus includes a time-frequency transform unit that performs a time-frequency transform on an audio signal, a normalization unit that normalizes a frequency spectral coefficient obtained by the time-frequency transform in order to generate encoded data of the audio signal, a level calculation unit that calculates a level of the audio signal, a scale factor changing unit that changes a concealment scale factor included in encoded concealment data obtained by performing, on the basis of the level of the audio signal, a time-frequency transform and normalization on a minute noise signal, the concealment scale factor being a scale factor relating to a coefficient used for the normalization, and an output unit that outputs the encoded data of the audio signal generated by the normalization unit or outputs, as encoded data of the audio signal, the encoded concealment data whose concealment scale factor has been changed.

16 Claims, 10 Drawing Sheets

ENCODING APPARATUS, ENCODING METHOD, DECODING APPARATUS, DECODING METHOD, AND PROGRAM

BACKGROUND

The present disclosure relates to an encoding apparatus, an encoding method, a decoding apparatus, a decoding method, and a program, and more particularly to an encoding apparatus, an encoding method, a decoding apparatus, a decoding method, and a program capable of generating an audio signal for concealment having a more natural sound.

In these years, audio signals are often digitized and resultant digital signals are compressed and encoded, and then transmitted or saved. Encoding of audio signals is generally categorized into waveform coding and analysis/synthesis coding. The waveform coding includes band division coding, in which an audio signal is divided into a plurality of frequency components using a band division filter and encoded, and transform coding, in which a digital audio signal is subjected to a time-frequency transform on a block-by-block basis and resultant spectra are encoded. In the waveform coding, an audio signal that has been divided into frequency components using a band division filter or a time-frequency transform is quantized on a band-by-band basis and subjected to highly efficient coding utilizing so-called auditory masking effect or the like.

FIG. 1 is a block diagram illustrating an example of the configuration of an encoding apparatus that performs transform coding.

An encoding apparatus 10 illustrated in FIG. 1 includes a time-frequency transform unit 11, a spectrum normalization unit 12, a spectrum quantization unit 13, an entropy encoding unit 14, a scale factor encoding unit 15, and a multiplexer 16.

The time-frequency transform unit 11 of the encoding apparatus 10 receives an audio signal, which is a time signal. The time-frequency transform unit 11 performs time-frequency transforms such as modified discrete cosine transforms (MDCTs) on the input audio signal on a frame-by-frame basis. The time-frequency transform unit 11 supplies a resultant frequency spectral coefficient (MDCT coefficient) for each frame to the spectrum normalization unit 12.

The spectrum normalization unit 12 groups the frequency spectral coefficients for the frames supplied from the time-frequency transform unit 11 on a quantization (quantization unit) basis for certain bandwidths. The spectrum normalization unit 12 normalizes the grouped frequency spectral coefficients for the quantization units using the following expression (1) and a coefficient $2^{-\lambda\times SF[n]}$ of a certain step size on a frame-by-frame basis.

$$X_{Norm}(k)=X(k)\times 2^{-\lambda\times SF[n]} \quad (1)$$

In the expression (1), X(k) denotes a k-th frequency spectral coefficient of an n-th quantization unit, and $X_{Norm}(k)$ denotes a normalized frequency spectral coefficient. In addition, $\lambda$ is a value for determining the step size. For example, if $\lambda=0.5$, the step size is 3 dB. Here, the step size $\lambda$ is assumed to be constant regardless of the frame. In addition, here, an index SF[n] (integer) as information regarding the coefficient $2^{-\lambda\times SF[n]}$ is called a "scale factor".

The spectrum normalization unit 12 supplies the frequency spectral coefficient for each frame that has been normalized as described above to the spectrum quantization unit 13 and a scale factor for each frame that has been used for the normalization to the scale factor encoding unit 15.

The spectrum quantization unit 13 quantizes the normalized frequency spectral coefficient for each frame supplied from the spectrum normalization unit 12 using a certain number of bits, and supplies the quantized frequency spectral coefficient for each frame to the entropy encoding unit 14. In addition, the spectrum quantization unit 13 supplies, to the multiplexer 16, quantization information indicating the number of bits of each quantization unit of the normalized frequency spectral coefficient for each frame during the quantization.

The entropy encoding unit 14 performs reversible compression on the quantized frequency spectral coefficient for each frame supplied from the spectrum quantization unit 13 by Huffman coding, arithmetic coding, or the like, and supplies a resultant frequency spectral coefficient to the multiplexer 16 as encoded spectrum data.

The scale factor encoding unit 15 encodes the scale factor for each frame supplied from the spectrum normalization unit 12. The scale factor encoding unit 15 supplies the encoded scale factor for each frame to the multiplexer 16 as an encoded scale factor.

The multiplexer 16 multiplexes the encoded spectrum data from the entropy encoding unit 14, the encoded scale factors from the scale factor encoding unit 15, and the quantization information from the spectrum quantization unit 13, in order to generate encoded data for each frame. The multiplexer 16 outputs the encoded data.

In the above-described encoding apparatus 10, an encoding error may occur due to a reason such as the number of bits of a frame is smaller than the number of bits necessary for encoding or encoding takes more time than a period of time during which real-time processing can be performed. In this case, since it is difficult to perform encoding again, it is necessary to prepare error concealment means that outputs encoded data for concealment instead of irregular data, so that the irregular data is not output as encoded data.

As the error concealment means, for example, a technique has been proposed in which, if encoding does not end before a time limit, encoded data of a frame located prior to a frame to be encoded is output as encoded data for concealment instead of encoded data of the frame to be encoded (for example, refer to Japanese Patent No. 3463592).

In addition, as the error concealment means, another technique has been proposed in which encoded data for concealment is prepared in advance by encoding a silent signal or the like and the encoded data is output instead of encoded data of a frame in which an encoding error has occurred (for example, refer to Japanese Unexamined Patent Application Publication No. 2003-5798).

On the other hand, an audio compression transmission apparatus has been proposed that, if a synchronization abnormality of encoded data has been detected during decoding, outputs, as encoded data for concealment, silent encoded data stored in advance instead of the encoded data (for example, refer to Japanese Patent No. 2731514).

In addition, an apparatus has been proposed that replaces, in accordance with a mute instruction from outside, encoded data with silent encoded data created in advance and outputs the silent encoded data (for example, refer to Japanese Unexamined Patent Application Publication No. 9-294077).

SUMMARY

However, in the case of the error concealment means described in Japanese Patent No. 3463592, if changes in the level of an audio signal to be encoded over time are large, the signal level of encoded data for concealment is significantly different from the signal level of original encoded data of a frame in which an encoding error has occurred. As a result, an audio signal having an unnatural sound may be generated as a result of the decoding of the encoded data for concealment.

In addition, in the case of the error concealment means described in Japanese Unexamined Patent Application Publication No. 2003-5798, the signal level of encoded data for concealment and the signal level of original encoded data of a frame in which an encoding error has occurred are significantly different from each other. As a result, an audio signal having an abnormal sound or a discontinuous, unnatural sound may be generated as a result of the decoding of the encoded data for concealment.

It is desirable to generate an audio signal for concealment having a more natural sound.

An encoding apparatus according to a first embodiment of the present disclosure includes a time-frequency transform unit that performs a time-frequency transform on an audio signal, a normalization unit that normalizes a frequency spectral coefficient obtained by the time-frequency transform in order to generate encoded data of the audio signal, a level calculation unit that calculates a level of the audio signal, a scale factor changing unit that changes a concealment scale factor included in encoded concealment data obtained by performing, on the basis of the level of the audio signal, a time-frequency transform and normalization on a minute noise signal, the concealment scale factor being a scale factor relating to a coefficient used for the normalization, and an output unit that, if an error has not occurred during encoding of the audio signal, outputs the encoded data of the audio signal generated by the normalization unit, and that, if an error has occurred during the encoding of the audio signal, outputs, as encoded data of the audio signal, the encoded concealment data whose concealment scale factor has been changed.

An encoding method and a program according to the first embodiment of the present disclosure correspond to the encoding apparatus according to the first embodiment of the present disclosure.

According to the first embodiment of the present disclosure, an audio signal is subjected to a time-frequency transform, a frequency spectral coefficient obtained by the time-frequency transform is normalized in order to generate encoded data of the audio signal, a level of the audio signal is calculated, a concealment scale factor included in encoded concealment data obtained by performing, on the basis of the level of the audio signal, a time-frequency transform and normalization on a minute noise signal is changed, the concealment scale factor being a scale factor relating to a coefficient used for the normalization, and, if an error has not occurred during encoding of the audio signal, the encoded data of the audio signal generated by the normalization unit is output, and, if an error has occurred during encoding of the audio signal, the encoded concealment data whose concealment scale factor has been changed is output as encoded data of the audio signal.

A decoding apparatus according to a second embodiment of the present disclosure includes an inverse normalization unit that performs inverse normalization on encoded data using a scale factor of the encoded data included in the encoded data supplied from an encoding apparatus that, if an error has not occurred during encoding of an audio signal, outputs the encoded data generated by performing a time-frequency transform and normalization on the audio signal, and that, if an error has occurred during the encoding of the audio signal, changes, on the basis of a level of the audio signal, a concealment scale factor included in encoded concealment data obtained by performing a time-frequency transform and normalization on a minute noise signal, the concealment scale factor being a scale factor relating to a coefficient used for the normalization, and then outputs the encoded concealment data as the encoded data of the audio signal, and a frequency-time transform unit that performs a frequency-time transform on a frequency spectrum obtained as a result of the inverse normalization performed by the inverse normalization unit.

A decoding method and program according to the second embodiment of the present disclosure correspond to the decoding apparatus according to the second embodiment of the present disclosure.

According to the second embodiment of the present disclosure, inverse normalization is performed on encoded data using a scale factor of the encoded data included in the encoded data supplied from an encoding apparatus that, if an error has not occurred during encoding of an audio signal, outputs the encoded data generated by performing a time-frequency transform and normalization on the audio signal, and, if an error has occurred during encoding of the audio signal, changes, on the basis of a level of the audio signal, a concealment scale factor included in encoded concealment data obtained by performing a time-frequency transform and normalization on a minute noise signal, the concealment scale factor being a scale factor relating to a coefficient used for the normalization, and outputs the encoded concealment data as the encoded data of the audio signal, and a frequency-time transform is performed on a frequency spectrum obtained as a result of the inverse normalization.

According to the first embodiment of the present disclosure, encoded data of an audio signal for concealment having a more natural sound can be generated.

According to the second embodiment of the present disclosure, an audio signal for concealment having a more natural sound can be generated.

DETAILED DESCRIPTION OF EMBODIMENTS

Embodiment

Example of Configuration of Encoding Apparatus According to Embodiment

Figure 2:
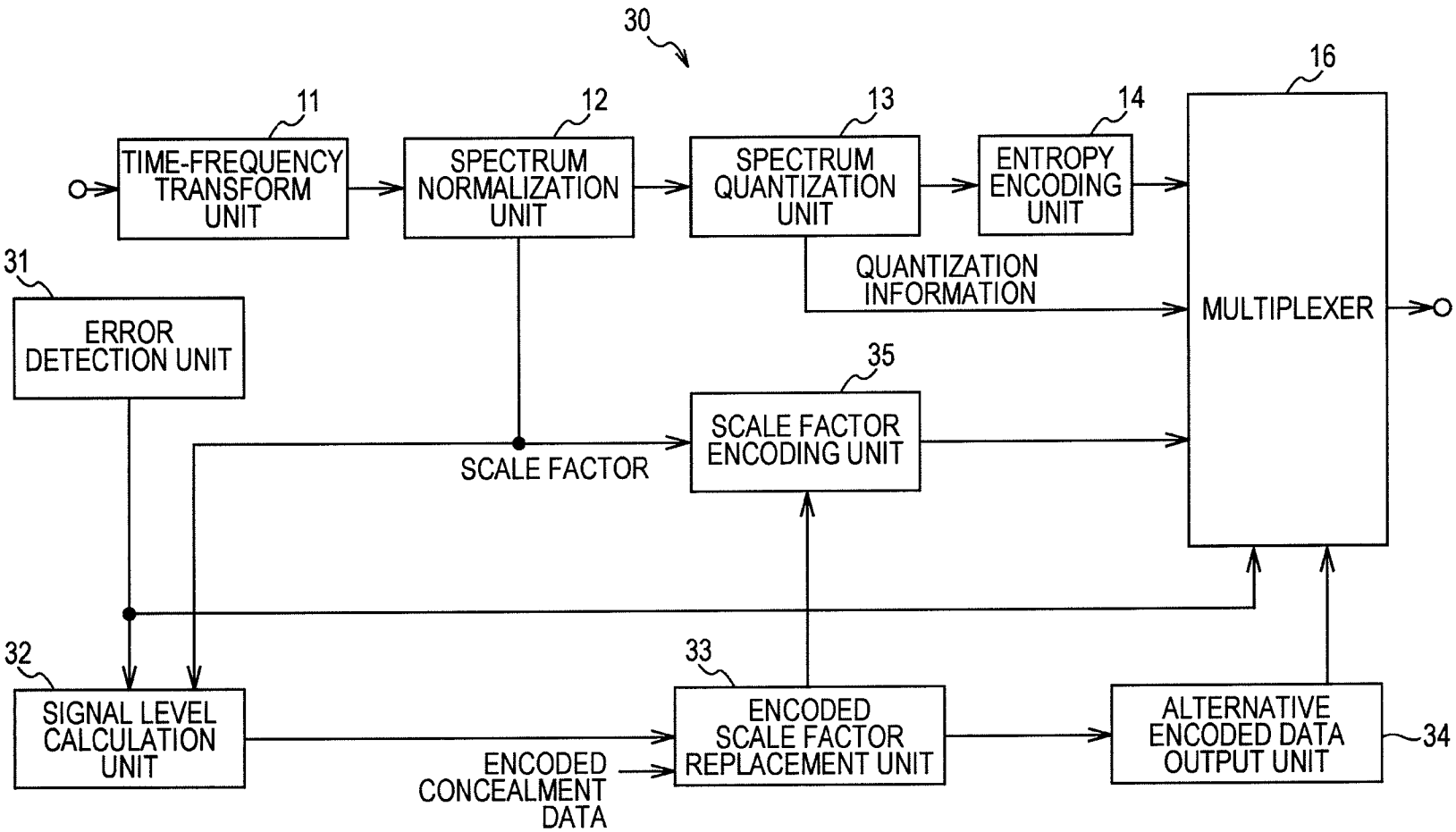
FIG. 2 is a block diagram illustrating an example of the configuration of an encoding apparatus according to an embodiment of the present disclosure.

FIG. 2 is a block diagram illustrating an example of the configuration of an encoding apparatus according to an embodiment of the present disclosure.

Figure 1:
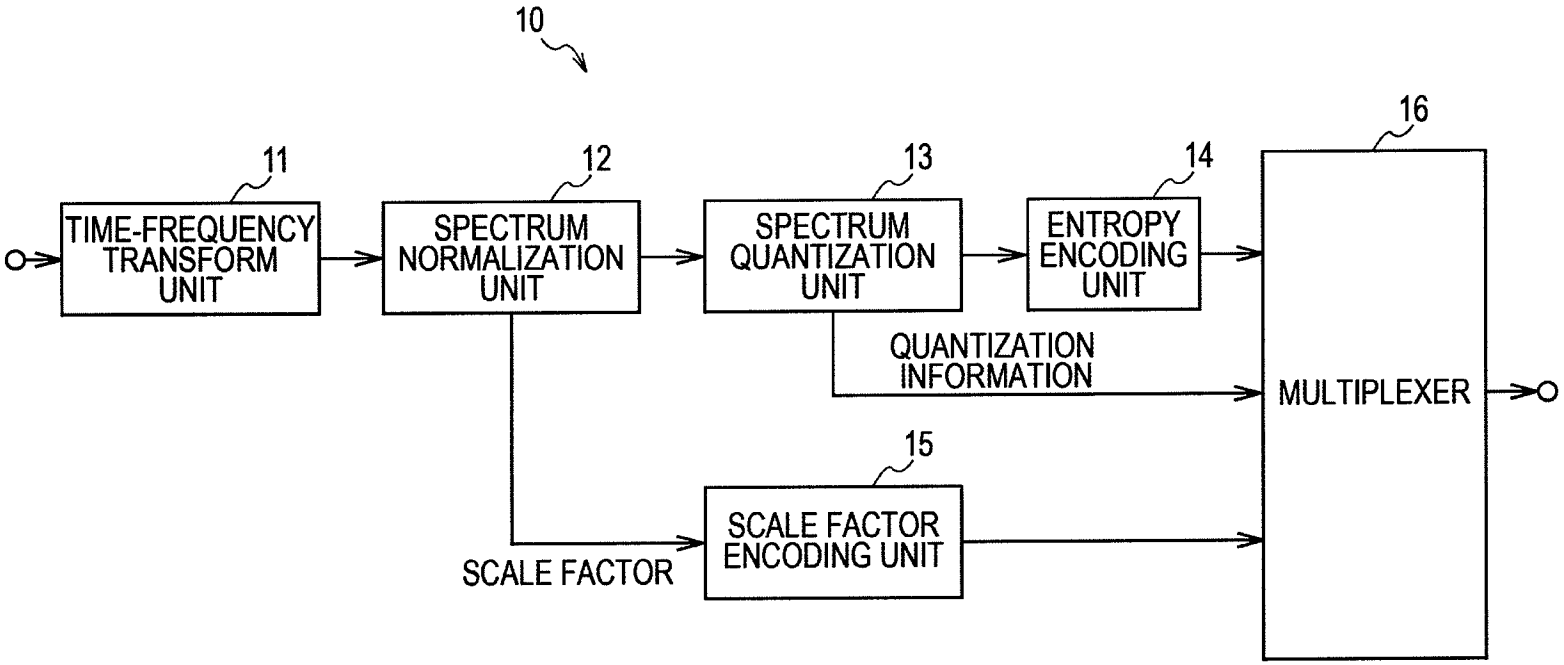
FIG. 1 is a block diagram illustrating an example of the configuration of an encoding apparatus in the related art.

In the configuration illustrated in FIG. 2, the same reference numerals as in FIG. 1 are given to components that are the same as those illustrated in FIG. 1. Redundant description is omitted as necessary.

The configuration of an encoding apparatus 30 illustrated in FIG. 2 is different from the configuration illustrated in FIG. 1 in that an error detection unit 31, a signal level calculation unit 32, an encoded scale factor replacement unit 33, and an alternative encoded data output unit 34 are newly provided and a scale factor encoding unit 35 and a multiplexer 36 are provided instead of a scale factor encoding unit 15 and a multiplexer 16, respectively. If an encoding error has occurred, the encoding apparatus 30 generates encoded data of an audio signal for concealment (hereinafter referred to as "encoded concealment data") for each frame on the basis of the level of the audio signal.

More specifically, the error detection unit 31 of the encoding apparatus 30 judges, on a frame-by-frame basis, whether or not an error has occurred during encoding and whether or not a certain period of time (for example, a period of time during which real-time processing can be performed) has elapsed since the encoding began. The error detection unit 31 detects an encoding error on the basis of results of the judgment, and then supplies results of the detection to the signal level calculation unit 32 and the multiplexer 36.

The signal level calculation unit 32 calculates an average value, a maximum value, or a minimum value of scale factors for the frames or the like obtained by a spectrum normalization unit 12 as the spectrum level of a frame of an audio signal to be encoded in accordance with the results of the detection supplied from the error detection unit 31. The signal level calculation unit 32 supplies the calculated spectrum level to the encoded scale factor replacement unit 33.

The encoded scale factor replacement unit 33 receives encoded concealment data stored in a memory, which is not illustrated, of the encoding apparatus 30 in advance. As the encoded concealment data, for example, data having a minimum frame length (the number of bits) that can be processed by the encoding apparatus 30 may be used, the data being obtained by encoding, as an audio signal for concealment, a minute noise signal in the same manner as for an audio signal to be input to the encoding apparatus 30.

The encoded scale factor replacement unit 33 serves as scale factor changing means, and changes an encoded scale factor included in encoded concealment data on the basis of the spectrum level supplied from the signal level calculation unit 32. The encoded scale factor replacement unit 33 supplies the encoded concealment data whose encoded scale factor has been changed to the alternative encoded data output unit 34. In addition, the encoded scale factor replacement unit 33 supplies a scale factor corresponding to the encoded scale factor after the change to the scale factor encoding unit 35 and causes the scale factor encoding unit 35 to hold the scale factor.

The alternative encoded data output unit 34 performs padding on the encoded concealment data supplied from the encoded scale factor replacement unit 33 such that the number of bits of the encoded concealment data corresponds to the output bit rate.

Since the encoded concealment data is data having a minimum frame length that can be processed by the encoding apparatus 30, the alternative encoding data output unit 34 can generate encoded concealment data having a frame length corresponding to any output bit rate by performing the padding. Therefore, it is not necessary for the encoding apparatus 30 to hold encoded concealment data for each frame length, thereby reducing the amount of data to be stored in the memory, which is not illustrated, for holding encoded concealment data.

The alternative encoded data output unit 34 supplies the encoded concealment data that has been subjected to the padding to the multiplexer 36.

The scale factor encoding unit 35 performs inter-frame prediction encoding on the scale factor for each frame supplied from the spectrum normalization unit 12 using a scale factor of a past frame held thereby. Thus, since the scale factor encoding unit 35 performs the inter-frame prediction encoding on a scale factor, the encoding efficiency can be improved.

The scale factor encoding unit 35 supplies the scale factor for each frame that has been subjected to the inter-frame prediction encoding to the multiplexer 36 as an encoded scale factor. In addition, the scale factor encoding unit 35 holds the scale factor for each frame supplied from the spectrum normalization unit 12 or the scale factor supplied from the encoded scale factor replacement unit 33 as a scale factor of a past frame.

The multiplexer 36 multiplexes encoded spectrum data from an entropy encoding unit 14, the encoded scale factor from the scale factor encoding unit 35, and quantization information from a spectrum quantization unit 13 in accordance with the results of the detection supplied from the error detection unit 31, in order to generate encoded data for each frame. The multiplexer 36 serves as output means, and, in accordance with the results of the detection from the error detection unit 31, outputs the generated encoded data for each frame or outputs, as encoded data of a frame in which an encoding error has occurred, the encoded concealment data that has been subjected to the padding and that has been supplied from the alternative encoded data output unit 34. The encoded data or the encoded concealment data output from the multiplexer 36 is, for example, temporarily held by an output buffer, which is not illustrated, and then transmitted to another apparatus.

If the cause of an encoding error is that the number of bits of a frame is smaller than the number of bits necessary for encoding or a certain period of time has elapsed since encoding began, the encoding error is likely to occur during quantization, in which complex bit allocation is performed. Therefore, when an encoding error is detected, a scale factor for each frame is likely to have been calculated. For this reason, in this embodiment, the signal level calculation unit 32 calculates the spectrum level using the scale factor for each frame.

However, if the scale factor for each frame has not been calculated when an encoding error is detected, the spectrum level is calculated using a frequency spectral coefficient for each frame that has been obtained before the detection of the encoding error or an audio signal itself. For example, if the frequency spectral coefficient for each frame has been calculated before the detection of the encoding error, an average value or a maximum value of frequency spectral coefficients is calculated as the spectrum level. If only an audio signal of each frame has been detected before the detection of the encoding error, appropriate scaling is performed on a maximum value, an average value, or the energy of time samples of the audio signal or the like in accordance with a time-frequency transform performed by a time-frequency transform unit 11, and the spectrum level is obtained.

Example of Frame Structure of Encoded Concealment Data

Figure 3:
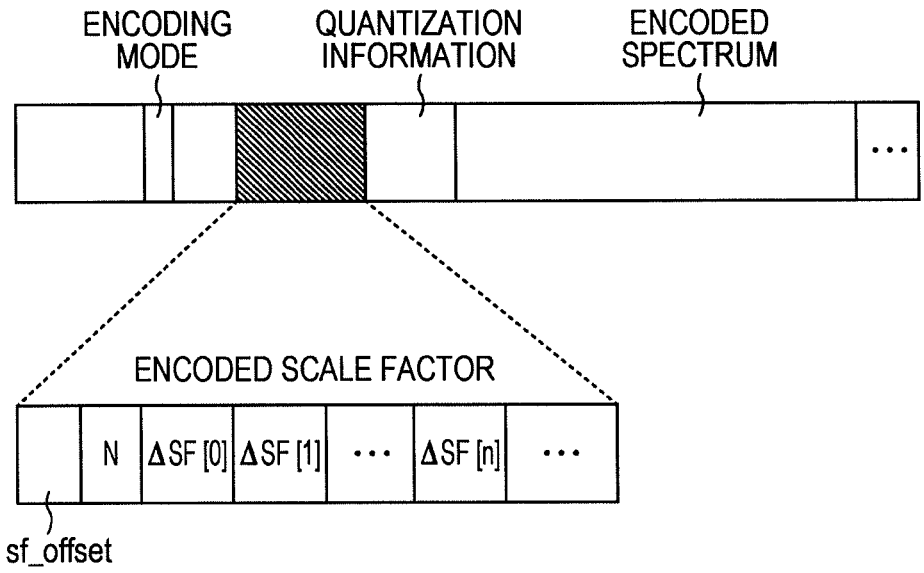
FIG. 3 is a diagram illustrating an example of the frame structure of encoded concealment data.

FIG. 3 is a diagram illustrating an example of the frame structure of encoded concealment data.

As illustrated in FIG. 3, in the encoded concealment data, an encoding mode of a scale factor, an encoded scale factor, quantization information, and an encoded spectrum of an audio signal for concealment and the like are multiplexed for each frame.

The encoding mode of a scale factor may be, for example, an offset mode in which encoding into an offset value and a difference from the offset value is performed, an inter-quantization unit prediction mode in which inter-quantization unit prediction encoding is performed, an inter-frame prediction mode in which inter-frame prediction encoding is performed, an inter-channel prediction mode in which inter-channel prediction encoding is performed, or the like.

In this embodiment, a scale factor of an audio signal for concealment is encoded in the offset mode. Therefore, as illustrated in FIG. 3, the encoded scale factor of the encoded concealment data is configured by the offset value sf_offset (integer), the number N of bits of difference information ΔSF[n] defined by the following expression (2), and the difference information ΔSF[n].

$$\Delta SF[n]=SF_{ec}[n]-sf_offset \quad (2)$$

In the expression (2), $SF_{ec}[n]$ denotes the scale factor of an audio signal for concealment of an n-th quantization unit. In addition, since an audio signal for concealment is a minute noise signal, the difference ΔSF[n] is sufficiently small, namely about N=2.

In addition, although not illustrated, the frame structure of encoded data of an original audio signal is configured in the same manner as that of the encoded concealment data illustrated in FIG. 3. However, the encoding mode is the inter-frame prediction mode and difference information in relation to a scale factor of each quantization unit of a past frame or the like is arranged as the encoded scale factor.

Description of Change of Scale Factor of Encoded Concealment Data

Figure 4:
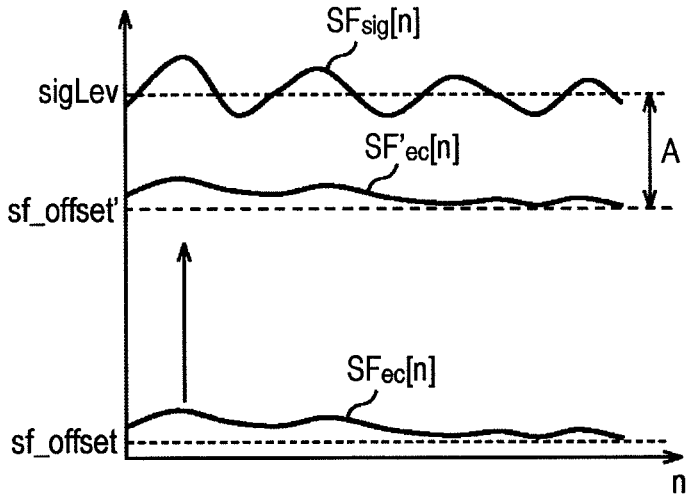
FIG. 4 is a diagram illustrating a change of an encoded scale factor.

FIG. 4 is a diagram illustrating a change of an encoded scale factor of encoded concealment data made by the encoded scale factor replacement unit 33. It is to be noted that, in FIG. 4, the horizontal axis represents the numbers n assigned to quantization units, and the vertical axis represents the level of a scale factor.

As illustrated in FIG. 4, if a scale factor for each frame of an audio signal to be input to the encoding apparatus 30 is assumed to be $SF_{sig}[n]$ and the spectrum level calculated by the signal level calculation unit 32 is assumed to be SigLev, the encoded scale factor replacement unit 33 changes the offset value sf_offset of the encoded scale factor to an offset value sf_offset' represented by the following expression (3):

$$sf_offset'=SigLev-A \quad (3)$$

In the expression (3), "A" is an integer for adjusting the level of an audio signal for concealment. As illustrated in FIG. 4, the integer A is desirably set such that a scale factor $SF'_{ec}[n]$ after the correction of the audio signal for concealment becomes slightly (several dB) smaller than the spectrum level SigLev.

When the offset value sf_offset has been changed to the offset value sf_offset', the scale factor $SP_{ec}[n]$ of the audio signal for concealment after the change is represented by the following expression (4):

$$SF'_{ec}[n]=\Delta SF[n]+sf_offset' \quad (4)$$

As described above, in the case of an encoded scale factor of encoded concealment data, the scale factor $SF_{ec}[n]$ of each quantization unit of an audio signal for concealment for each frame is expressed by the difference ΔSF[n] from the offset value sf_offset. Therefore, the encoded scale factor replacement unit 33 can easily change the scale factors of all the quantization units of an audio signal for concealment for each frame just by changing the offset values sf_offset. In addition, since the encoded scale factor replacement unit 33 changes only the offset value sf_offset, the number N of bits of the difference information ΔSF[n] and the difference information ΔSF[n] do not change.

Description of Process Performed by Encoding Apparatus

Figure 5:
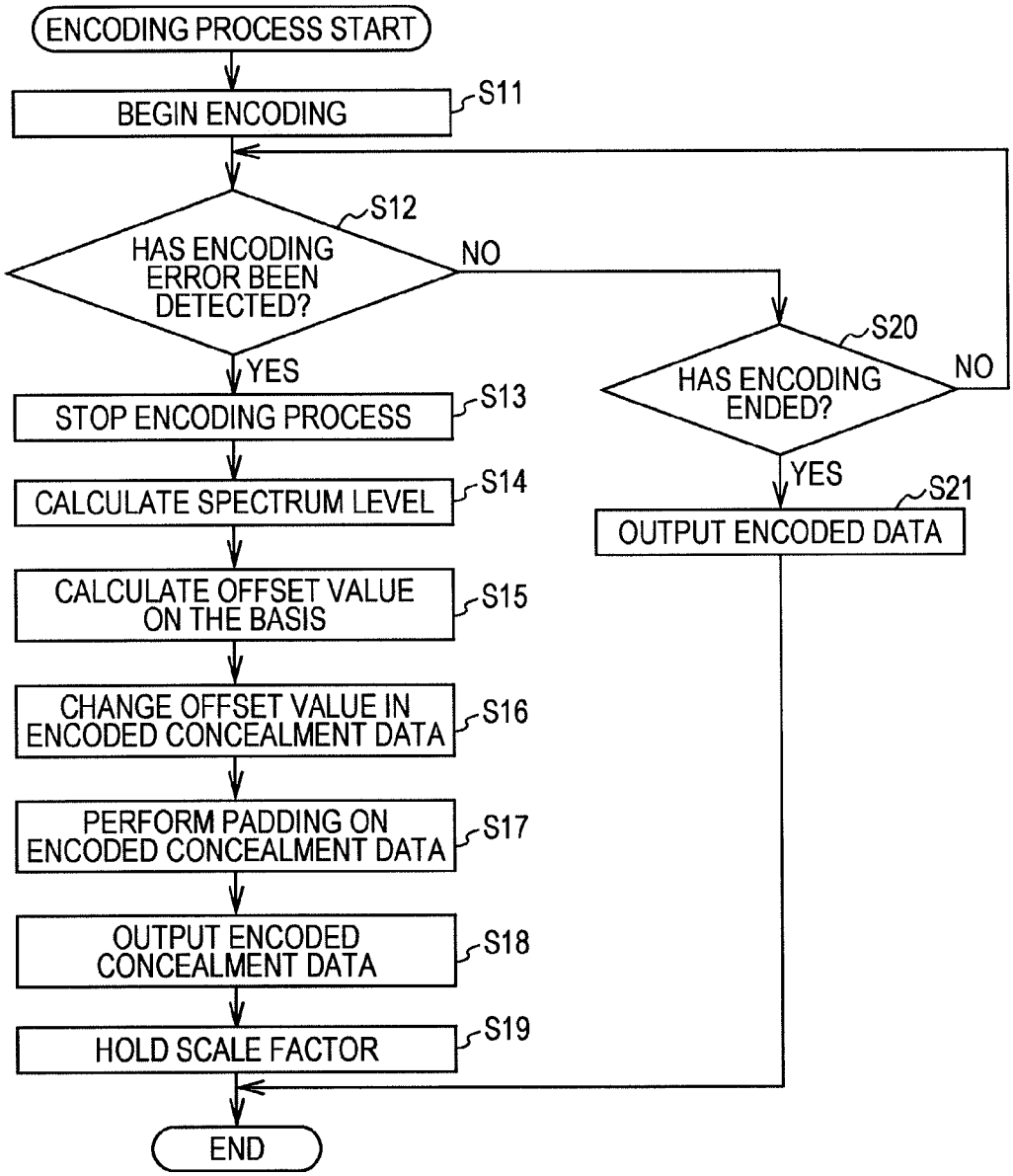
FIG. 5 is a flowchart illustrating an encoding process performed by the encoding apparatus illustrated in FIG. 2.

FIG. 5 is a flowchart illustrating an encoding process performed by the encoding apparatus 30 illustrated in FIG. 2. The encoding process is performed for each frame while sequentially setting an audio signal for each frame as the encoding target.

In step S11 illustrated in FIG. 5, the encoding apparatus 30 begins to encode the encoding target. More specifically, a process performed by the time-frequency transform unit 11, the spectrum normalization unit 12, the spectrum quantization unit 13, the entropy encoding unit 14, and the scale factor encoding unit 35 is begun. When the encoding target is an audio signal of a first frame, the encoding apparatus 30 is initialized and then the encoding is performed.

In step S12, the error detection unit 31 judges whether or not an encoding error has been detected. More specifically, the error detection unit 31 judges whether or not an error has occurred during the encoding and whether or not a certain period of time (for example, a period of time during which real-time processing can be performed) has elapsed since the encoding began. If an error has occurred during the encoding or if a certain period of time has elapsed since the encoding began, it is judged in step S12 that an encoding error has been detected. The error detection unit 31 supplies results of the detection that indicate detection of the encoding error to the signal level calculation unit 32 and the multiplexer 36.

In step S13, the encoding apparatus 30 stops the encoding of the encoding target and performs an error concealment process in the following steps S14 to S19.

More specifically, in step S14, the signal level calculation unit 32 calculates an average value, a maximum value, or a minimum value of scale factors the frames or the like obtained by the spectrum normalization unit 12 as the spectrum level in accordance with the results of the detection from the error detection unit 31. The signal level calculation unit 32 supplies the calculated spectrum level to the encoded scale factor replacement unit 33.

In step S15, the encoded scale factor replacement unit 33 calculates the offset value sf_offset' using the above-mentioned expression (3) on the basis of the spectrum level supplied from the signal level calculation unit 32.

In step S16, the encoded scale factor replacement unit 33 changes the offset value of the encoded scale factor included in the encoded concealment data on the basis of the offset value sf_offset'. The encoded scale factor replacement unit 33 supplies the encoded concealment data whose offset value has been changed to the alternative encoding data output unit 34.

In step S17, the alternative encoding data output unit 34 performs padding on the encoded concealment data such that the number of bits of the encoded concealment data supplied from the encoded scale factor replacement unit 33 corresponds to the output bit rate. The alternative encoding data output unit 34 then supplies the encoded concealment data that has been subjected to the padding to the multiplexer 36.

In step S18, the multiplexer 36 outputs the encoded concealment data that has been subjected to the padding and that has been supplied from the alternative encoding data output unit 34 as the target encoded data in accordance with the results of the detection supplied from the error detection unit 31.

In step S19, the encoded scale factor replacement unit 33 supplies the scale factor $SF'_{ec}[n]$ that corresponds to the encoded scale factor whose offset value has been changed in the process performed in step S16 and that is represented by the above-mentioned expression (4) to the scale factor encoding unit 35 and causes the scale factor encoding unit 35 to hold the scale factor $SF'_{ec}[n]$.

As a result, the scale factor $SF_{sig}[n]$ held by the scale factor encoding unit 35 is represented by the following expression (5):

$$SF_{sig}[n]=SF'_{ec}[n]=\Delta SF[n]+sf_offset' \quad (5)$$

Thus, even if an encoding error has occurred, since the scale factor of the encoded concealment data, which is the target encoded data, is held by the scale factor encoding unit 35, the scale factor encoding unit 35 can properly perform inter-frame prediction encoding using the scale factor held thereby when encoding the next frame.

On the other hand, if an error has not occurred and a certain period of time has not elapsed since the encoding began, it is judged in step S12 that an encoding error has not been detected. The error detection unit 31 supplies results of the detection that indicate that an encoding error has not been detected to the signal level calculation unit 32 and the multiplexer 36.

In step S20, the encoding apparatus 30 judges whether or not the encoding of the encoding target has ended. If it has been judged that the encoding of the encoding target has not ended, the process returns to step S12. The process in steps S12 to S20 is then repeated until the encoding of the encoding target ends.

If it has been judged in step S20 that the encoding of the encoding target has ended, the multiplexer 36 outputs the target encoded data generated by the encoding in accordance with the results of the detection supplied from the error detection unit 31, and terminates the process.

As described above, since the encoding apparatus 30 changes the scale factor of the encoded concealment data on the basis of the level of an audio signal to be encoded, encoded concealment data that has a more natural sound can be generated.

Example of Configuration of Decoding Apparatus

Figure 6:
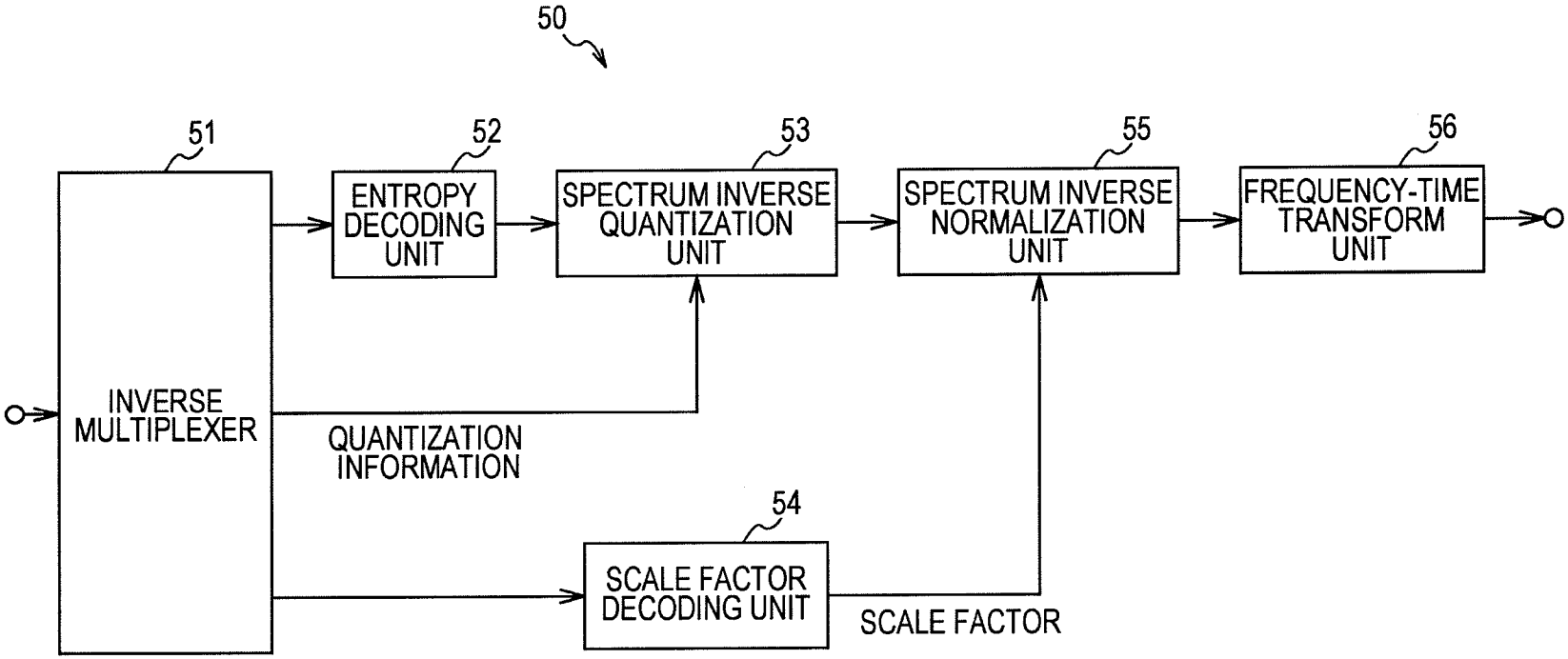
FIG. 6 is a block diagram illustrating an example of the configuration of a decoding apparatus.

FIG. 6 is a block diagram illustrating an example of the configuration of a decoding apparatus that decodes encoded data output from the encoding apparatus 30 illustrated in FIG. 2.

A decoding apparatus 50 illustrated in FIG. 6 includes an inverse multiplexer 51, an entropy decoding unit 52, a spectrum inverse quantization unit 53, a scale factor decoding unit 54, a spectrum inverse normalization unit 55, and a frequency-time transform unit 56. The decoding apparatus 50 decodes encoded data for each frame output from the encoding apparatus 30 and outputs a resultant audio signal.

More specifically, the inverse multiplexer 51 serves as extraction means and, if the encoded data for each frame supplied from the encoding apparatus 30 has been subjected to padding, extracts encoded data before the padding from the encoded data. The inverse multiplexer 51 performs inverse multiplexing on the extracted encoded data before the padding or encoded data for each frame that has not been subjected to padding and that has been supplied from the encoding apparatus 30, in order to extract encoded spectrum data, an encoded scale factor, and quantization information. The inverse multiplexer 51 supplies the encoded spectrum data to the entropy decoding unit 52 and the quantization information to the spectrum inverse quantization unit 53. In addition, the inverse multiplexer 51 supplies the encoded scale factor to the scale factor decoding unit 54.

The entropy decoding unit 52 performs, on the encoded spectrum data supplied from the inverse multiplexer 51, reversible decoding that corresponds to reversible compression such as Huffman coding or arithmetic coding, and supplies a resultant quantized frequency spectral coefficient for each frame to the spectrum inverse quantization unit 53.

The spectrum inverse quantization unit 53 performs inverse quantization on the quantized frequency spectral coefficient for each frame supplied from the entropy decoding unit 52 on the basis of the quantization information supplied from the inverse multiplexer 51, in order to obtain a normalized frequency spectral coefficient for each frame. The spectrum inverse quantization unit 53 supplies the normalized frequency spectral coefficient for each frame to the spectrum inverse normalization unit 55.

The scale factor decoding unit 54 decodes the encoded scale factor supplied from the inverse multiplexer 51 in order to obtain a scale factor for each frame. More specifically, if the encoding mode is the offset mode, the scale factor decoding unit 54 calculates the scale factor $SF'_{ec}[n]$ using the offset value sf_offset' and the difference information $\Delta SF[n]$ included in the encoded scale factor and the above-mentioned expression (4).

On the other hand, if the encoding mode is the inter-frame prediction mode, the scale factor decoding unit 54 performs inter-frame prediction decoding on the encoded scale factor using a scale factor of a past frame held thereby. More specifically, the scale factor decoding unit 54 calculates a scale factor of a current frame by adding the difference information included in the encoded scale factor and a scale factor of a past frame held thereby. The scale factor decoding unit 54 holds the obtained scale factor for each frame and supplies the scale factor to the spectrum inverse normalization unit 55.

The spectrum inverse normalization unit 55 performs, for each quantization unit, inverse normalization on the normalized frequency spectral coefficient for each frame supplied from the spectrum inverse quantization unit 53 on the basis of the scale factor for each frame supplied from the scale factor decoding unit 54. The spectrum inverse normalization unit 55 supplies a frequency spectral coefficient for each frame obtained as a result of the inverse normalization to the frequency-time transform unit 56.

The frequency-time transform unit 56 performs a frequency-time transform such as inverse modified discrete cosine transform (IMDCT) on the frequency spectral coefficient for each frame supplied from the spectrum inverse normalization unit 55. The frequency-time transform unit 56 outputs an audio signal, which is a resultant time signal for each frame.

If the IMDCT is performed on the frequency spectral coefficient for each frame, an audio signal of each frame is an audio signal obtained by superimposing an audio signal corresponding to the frequency spectral coefficient of the corresponding frame and an audio signal corresponding to the frequency spectral coefficient of a previous frame.

Here, the scale factor of encoded concealment data is, as described above, set on the basis of the spectrum level of an audio signal at a time when an encoding error occurs. Therefore, the spectrum level of an audio signal for concealment is not significantly different from the spectrum level of an original audio signal. As a result, by adding audio signals corresponding to frequency spectral coefficients of previous and next frames using the frequency-time transform unit 56, the audio signal for concealment can be smoothly connected to audio signals of the previous and next frames.

Description of Decoding Process

Figure 7:
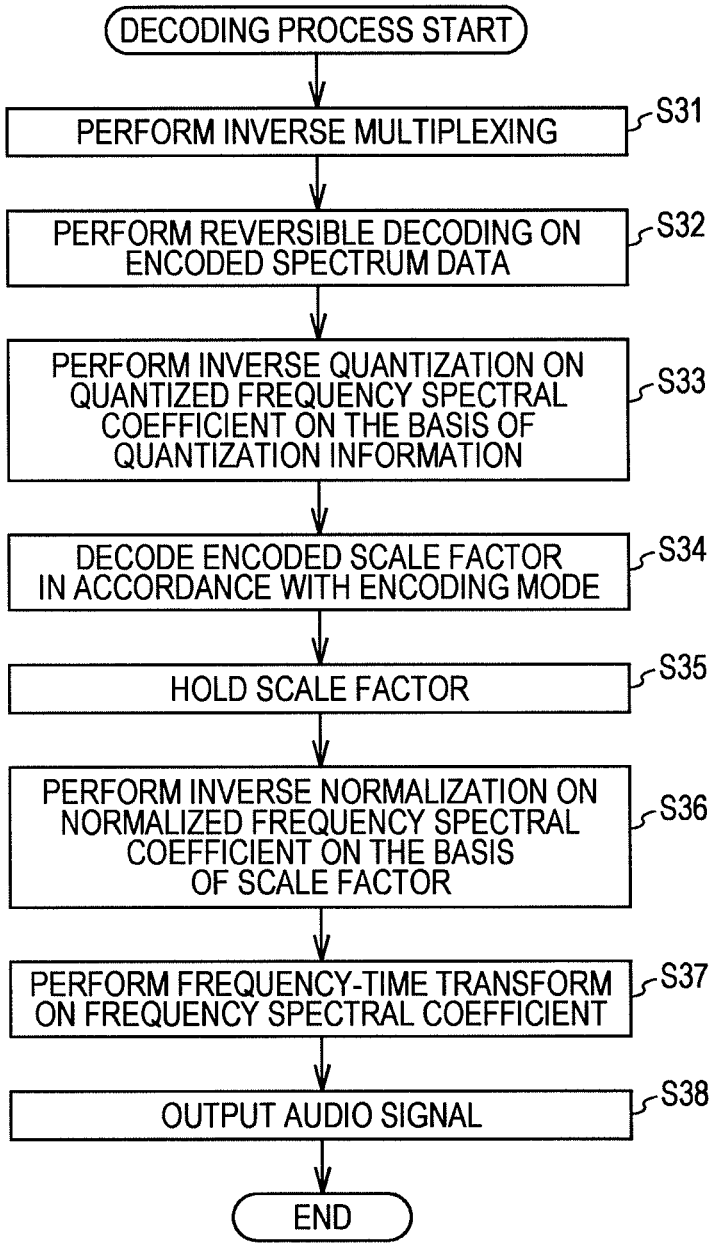
FIG. 7 is a flowchart illustrating a decoding process performed by the decoding apparatus illustrated in FIG. 6.

FIG. 7 is a flowchart illustrating a decoding process performed by the decoding apparatus 50 illustrated in FIG. 6. The decoding process is begun when, for example, the encoded data for each frame output from the encoding apparatus 30 illustrated in FIG. 2 is input to the decoding apparatus 50. When the decoding process is performed on encoded data of the first frame, the decoding apparatus 50 is initialized before the decoding process.

In step S31 illustrated in FIG. 7, the inverse multiplexer 51 performs inverse multiplexing on the encoded data for each frame supplied from the encoding apparatus 30 in order to extract encoded spectrum data, an encoded scale factor, and quantization information. If the encoded data for each frame supplied from the encoding apparatus 30 has been subjected to padding, the inverse multiplexer 51 extracts encoded data before the padding and then performs inverse multiplexing. The inverse multiplexer 51 supplies the encoded spectrum data to the entropy decoding unit 52 and the quantization information to the spectrum inverse quantization unit 53. In addition, the inverse multiplexer 51 supplies the encoded scale factor to the scale factor decoding unit 54.

In step S32, the entropy decoding unit 52 performs, on the encoded spectrum data supplied from the inverse multiplexer 51, reversible decoding that corresponds to reversible compression such as Huffman coding or arithmetic coding. The entropy decoding unit 52 then supplies a resultant quantized frequency spectral coefficient for each frame to the spectrum inverse quantization unit 53.

In step S33, the spectrum inverse quantization unit 53 performs inverse quantization on the quantized frequency spectral coefficient for each frame supplied from the entropy decoding unit 52 on the basis of the quantization information supplied from the inverse multiplexer 51. The spectrum inverse quantization unit 53 supplies a resultant normalized frequency spectral coefficient for each frame to the spectrum inverse normalization unit 55.

In step S34, the scale factor decoding unit 54 decodes the encoded scale factor supplied from the inverse multiplexer 51 in accordance with the encoding mode included in the encoded scale factor, in order to obtain a scale factor.

In step S35, the scale factor decoding unit 54 holds the obtained scale factor. If the encoding mode of an encoded scale factor of a frame located after a current frame to be decoded, the scale factor is used to decode the encoded scale factor. The scale factor decoding unit 54 supplies the obtained scale factor to the spectrum inverse normalization unit 55.

In step S36, the spectrum inverse normalization unit 55 performs, for each quantization unit, inverse normalization on the normalized frequency spectral coefficient for each frame supplied from the spectrum inverse quantization unit 53 on the basis of the scale factor for each frame supplied from the scale factor decoding unit 54. The spectrum inverse normalization unit 55 supplies a frequency spectral coefficient for each frame obtained as a result of the inverse normalization to the frequency-time transform unit 56.

In step S37, the frequency-time transform unit 56 performs a frequency-time transform such as the IMDCT on the frequency spectral coefficient for each frame supplied from the spectrum inverse normalization unit 55.

In step S38, the frequency-time transform unit 56 outputs an audio signal, which is a time signal for each frame obtained as a result of the frequency-time transform, and then terminates the process.

As described above, the decoding apparatus 50 performs inverse normalization on the normalized frequency spectral coefficient of the encoded concealment data on the basis of the encoded scale factor that is included in the encoded concealment data and that has been changed on the basis of the spectrum level of an original audio signal. As a result, the decoding apparatus 50 can generate an audio signal for concealment whose spectrum level corresponds to the spectrum level of the original audio signal and that has a natural sound as a result of the decoding.

Another Example of Configuration of Decoding Apparatus

Figure 8:
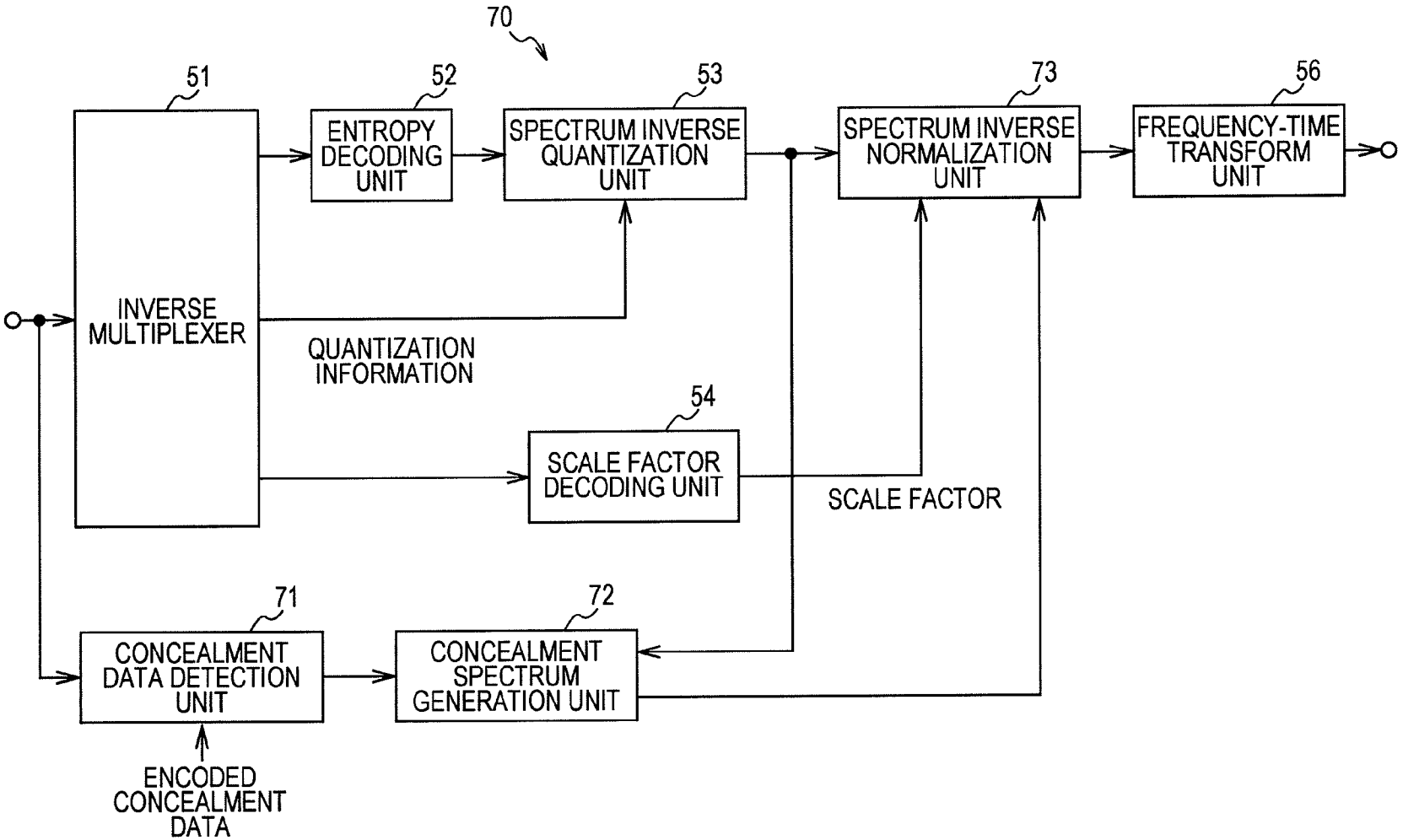
FIG. 8 is a block diagram illustrating another example of the configuration of a decoding apparatus.

FIG. 8 is a block diagram illustrating another example of the configuration of a decoding apparatus that decodes encoded data output from the encoding apparatus 30.

In the configuration illustrated in FIG. 8, the same reference numerals as in FIG. 6 are given to components that are the same as those illustrated in FIG. 6. Redundant description is omitted as necessary.

The configuration of a decoding apparatus 70 illustrated in FIG. 8 is different from the configuration illustrated in FIG. 6 in that a concealment data detection unit 71 and a concealment spectrum generation unit 72 are newly provided and a spectrum inverse normalization unit 73 is provided instead of the spectrum inverse normalization unit 55. If the encoded data for each frame supplied from the encoding apparatus 30 is encoded concealment data, the decoding apparatus 70 does not decode the encoded concealment data but newly generates an audio signal for concealment.

More specifically, the concealment data detection unit 71 of the decoding apparatus 70 serves as judgment means, and compares encoded concealment data that is held by a memory, which is not illustrated, and that is identical with the encoded concealment data held by the encoding apparatus 30 and the encoded data for each frame supplied from the encoding apparatus 30. The concealment data detection unit 71 judges, on the basis of results of the comparison, whether or not the encoded data for each frame supplied from the encoding apparatus 30 is encoded concealment data, and supplies results of the judgment to the concealment spectrum generation unit 72.

The concealment spectrum generation unit 72 generates a coefficient for concealment on the basis of the normalized frequency spectral coefficient for each frame obtained by the spectrum inverse quantization unit 53 in accordance with the results of the judgment supplied from the concealment data detection unit 71. The coefficient for concealment is a normalized frequency spectral coefficient of an audio signal for concealment generated by the decoding apparatus 70. The concealment spectrum generation unit 72 supplies the generated coefficient for concealment to the spectrum inverse normalization unit 73.

The spectrum inverse normalization unit 73 performs inverse normalization on the normalized frequency spectral coefficient from the spectrum inverse quantization unit 53 or the coefficient for concealment from the concealment spectrum generation unit 72 on the basis of the scale factor from the scale factor decoding unit 54. The spectrum inverse normalization unit 73 supplies a frequency spectral coefficient obtained as a result of the inverse normalization to the frequency-time transform unit 56. As a result, an audio signal corresponding to the normalized frequency spectral coefficient from the spectrum inverse quantization unit 53 is generated as an original signal and an audio signal corresponding to the coefficient for concealment is generated as a new audio signal for concealment.

Description of Comparison of Encoded Data

Figure 9:
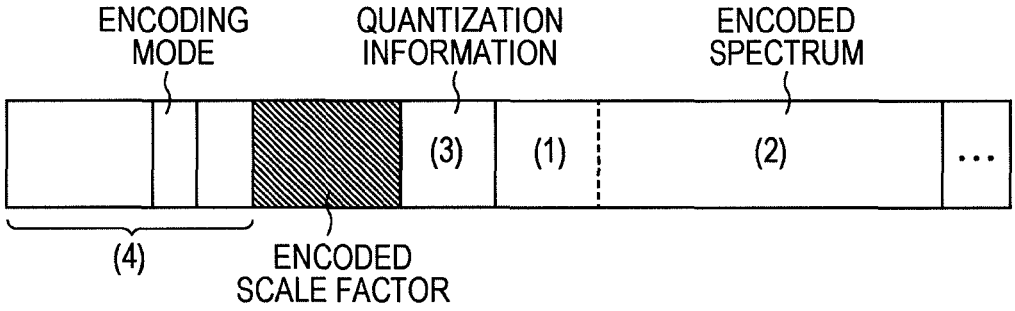
FIG. 9 is a diagram illustrating a comparison of encoded data.

FIG. 9 is a diagram illustrating a comparison of encoded data performed by the concealment data detection unit 71 illustrated in FIG. 8.

As illustrated in FIG. 9, an encoding mode, an encoded scale factor, quantization information, and an encoded spectrum are arranged in each frame of the encoded concealment data held by the memory, which is not illustrated, and the encoded data for each frame supplied from the encoding apparatus 30.

The concealment data detection unit 71 compares the encoded concealment data and encoded data for each frame except for the encoded scale factor. It is to be noted that the concealment data detection unit 71 may collectively compare data except for the encoded scale factor at once or may compare data stepwise by dividing the data.

If the concealment data detection unit 71 compares the data except for the encoded scale factor stepwise, first, data (1) of several bytes illustrated in FIG. 9 that is most characteristic in the encoded spectrum is extracted from the encoded concealment data and the encoded data for each frame. The data (1) may be, for example, data of several bytes whose frequency of pattern appearance is low.

Next, the concealment data detection unit 71 compares the data (1) of the encoded concealment data and the encoded data for each frame. Since the data (1) is data of several bytes, the comparison can be performed at high speed. If it has been found that the data (1) of the encoded concealment data and the encoded data for each frame does not match as a result of the comparison, the concealment data detection unit 71 judges that the encoded data for each frame is not the encoded concealment data.

On the other hand, if the data (1) of the encoded concealment data and the encoded data for each frame matches, the concealment data detection unit 71 extracts, for example, data (2), which is data other than the data (1) in encoded spectra, of the encoded concealment data and the encoded data for each frame and compares the data (2). If it has been found that the data (2) of the encoded concealment data and the encoded data for each frame does not match as a result of the comparison, the concealment data detection unit 71 judges that the encoded data for each frame is not the encoded concealment data.

In the same manner as above, the concealment data detection unit 71 extracts quantization information (3) from the encoded concealment data and the encoded data for each frame and compares the quantization information (3). If the quantization information (3) matches, the concealment data detection unit 71 extracts data (4), which is data other than encoded scale factors, the data (1), the data (2), and the quantization information (3), from the encoded concealment data and the encoded data for each frame, and compares the data (4). If the data (1), the data (2), the quantization information (3), and the data (4) of the encoded concealment data and the encoded data for each frame all match, the concealment data detection unit 71 judges that the encoded data for each frame is the encoded concealment data. On the other hand, if the quantization information (3) or the data (4) of the encoded concealment data and the encoded data for each frame does not match, the concealment data detection unit 71 judges that the encoded data for each frame is not the encoded concealment data.

As described above, when comparing the data other than the encode scale factors stepwise, the concealment data detection unit 71 can judge that the encoded data for each frame is not the encoded concealment data when any of the data (1), the data (2), the quantization information (3), and the data (4) of the encoded concealment data and the encoded data for each frame does not match. Therefore, the concealment data detection unit 71 can efficiently judge whether or not the encoded data for each frame is the encoded concealment data.

In addition, the concealment data detection unit 71 judges that the encoded data for each frame is the encoded concealment data when all the data except for the encoded scale factors matches, it is possible to accurately detect the encoded concealment data.

It is to be understood that the order of the comparisons of the data (2), the quantization information (3), and the data (4) is not limited to the above-described case.

Description of Another Decoding Process

Figure 10:
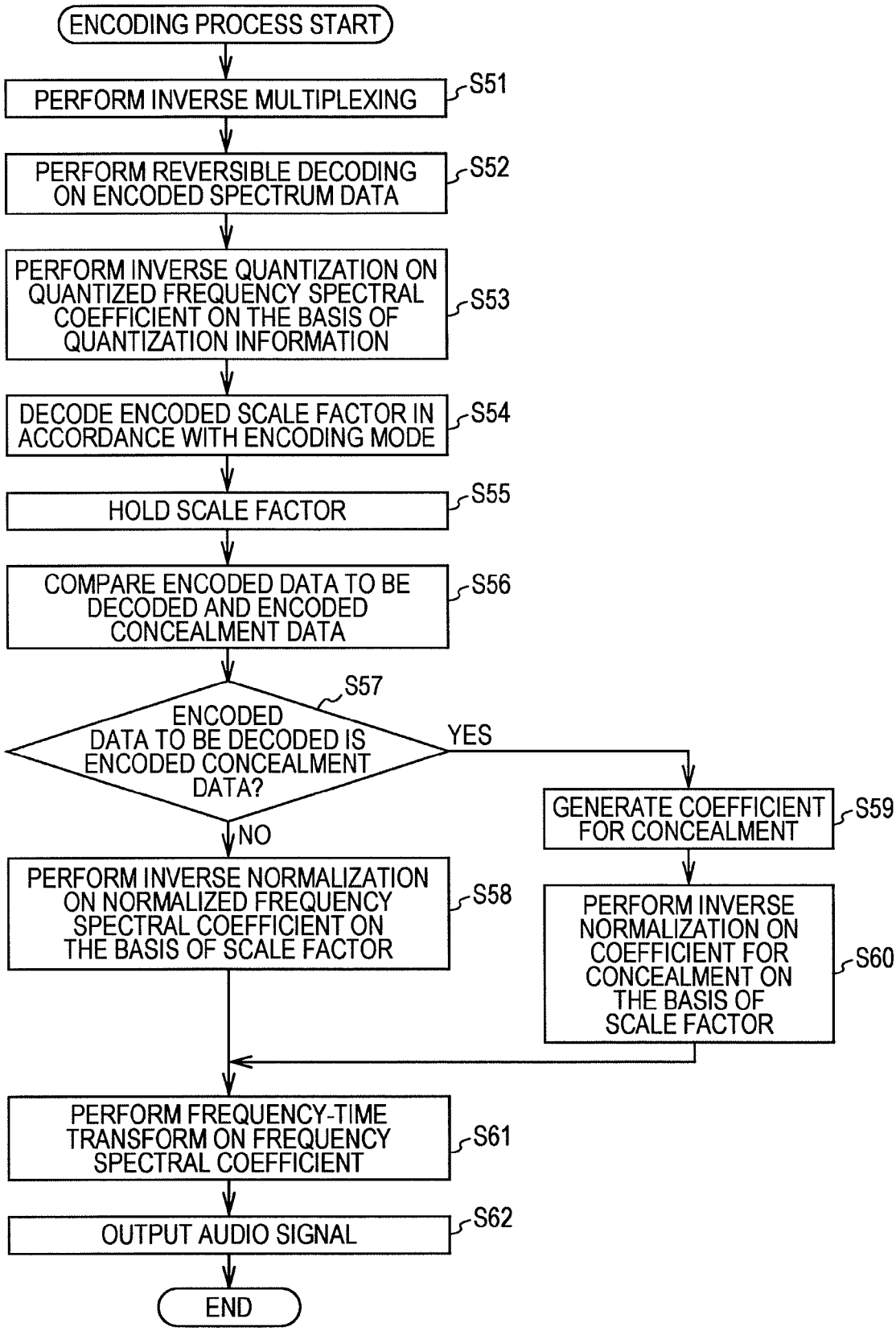
FIG. 10 is a flowchart illustrating a decoding process performed by the decoding apparatus illustrated in FIG. 8.

FIG. 10 is a flowchart illustrating a decoding process performed by the decoding apparatus 70 illustrated in FIG. 8. The decoding process is begun when, for example, the encoded data for each frame output from the encoding apparatus 30 illustrated in FIG. 2 is input to the decoding apparatus 70. When the decoding process is performed on encoded data of the first frame, the decoding apparatus 70 is initialized before the decoding process.

The process performed in steps S51 to S55 illustrated in FIG. 10 is the same as that performed in steps S31 to S35 illustrated in FIG. 7, and therefore description thereof is omitted.

After the process performed in step S55, as illustrated in FIG. 9, the concealment data detection unit 71 compares the data of the encoded data for each frame to be decoded and the encoded concealment data except for the encoded scale factors in step S56.

In step S57, the concealment data detection unit 71 judges whether or not the encoded data for each frame to be decoded is the encoded concealment data on the basis of results of the comparison, and supplies results of the judgment to the concealment spectrum generation unit 72.

If it has been judged in step S57 that the encoded data for each frame to be decoded is not the encoded concealment data, the process proceeds to step S58. In step S58, the spectrum inverse normalization unit 73 performs inverse normalization on the normalized frequency spectral coefficient from the spectrum inverse quantization unit 53 on the basis of the scale factor from the scale factor decoding unit 54. The spectrum inverse normalization unit 73 supplies a frequency spectral coefficient obtained as a result of the inverse normalization to the frequency-time transform unit 56. The process then proceeds to step S61.

On the other hand, if it has been judged in step S57 that the encoded data for each frame to be decoded is the encoded concealment data, the process proceeds to step S59.

In step S59, the concealment spectrum generation unit 72 generates a coefficient for concealment on the basis of the normalized frequency spectral coefficient obtained by the spectrum inverse quantization unit 53. More specifically, the concealment spectrum generation unit 72 generates, as the coefficient for concealment, an average value of the normalized frequency spectral coefficients of frames located before the frame to be decoded or an average value of the normalized frequency spectral coefficient of frames located immediately before and after the frame to be decoded.

However, if the normalized frequency spectral coefficient of a frame located after the frame to be decoded is used to generate the coefficient for concealment, a delay is caused. It is to be understood that a method for generating the coefficient for concealment is not limited to the above-described method. The concealment spectrum generation unit 72 supplies the generated coefficient for concealment to the spectrum inverse normalization unit 73.

In step S60, the spectrum inverse normalization unit 73 performs inverse normalization on the coefficient for concealment supplied from the concealment spectrum generation unit 72 on the basis of the scale factor from the scale factor decoding unit 54. The spectrum inverse normalization unit 73 supplies a frequency spectral coefficient obtained as a result of the inverse normalization to the frequency-time transform unit 56. The process then proceeds to step S61.

The process performed in steps S61 and S62 is the same as that performed in steps S37 and S38 illustrated in FIG. 7, and therefore description thereof is omitted.

If it has been judged that the encoded data to be decoded is the encoded concealment data by the above-described process performed in steps S59 to S61, a new audio signal for concealment is generated using the encoded scale factor included in the encoded concealment data and encoded data located before or after the encoded concealment data. Therefore, in this case, the concealment spectrum generation unit 72, the spectrum inverse normalization unit 73, and the frequency-time transform unit 56 serve as generation means for generating the new audio signal for concealment.

It is to be noted that although the process in steps S52 and S53 is supposed to be performed regardless of the decoding target being the encoded concealment data or the encoded data of an original audio signal in the decoding process illustrated in FIG. 10, it is not necessary to perform the process in steps S52 and S53 when the decoding target is the encoded concealment data.

As described above, the decoding apparatus 70 judges whether or not the encoded data for each frame to be decoded is the encoded concealment data by comparing the encoded data for each frame to be decoded and the encoded concealment data. Therefore, it is not necessary for the encoding apparatus 30 to transmit, to the decoding apparatus 70, a flag indicating whether or not the encoded data is the encode concealment data, thereby reducing the number of bits to be transmitted. In contrast, when it is necessary to transmit a flag indicating whether or not the encoded data is the encoded concealment data to the decoding apparatus, that is, for example, when the format of the encoded data has already been determined, it is necessary to add the flag to the encoded data as a new header or determine a new format.

In addition, if the encoded data for each frame to be decoded is the encoded concealment data, the decoding apparatus 70 generates a coefficient for concealment and performs inverse normalization on the coefficient for concealment on the basis of the encoded scale factor included in the encoded concealment data. Therefore, the decoding apparatus 70 can easily generate an audio signal for concealment whose spectrum level corresponds to the spectrum level of an original audio signal and that has a natural sound just by generating the coefficient for concealment. In contrast, in the case of a decoding apparatus that generates an audio signal for concealment without using a scale factor based on the spectrum level of an original audio signal of a frame in which an encoding error has occurred, a lot of resources such as a computing unit and a memory are necessary and it is difficult to generate an audio signal for concealment that has a natural sound.

Furthermore, since the decoding apparatus 70 generates the coefficient for concealment on the basis of the normalized frequency spectral coefficient of a frame located at least either before or after the frame to be decoded, an audio signal for concealment that has a more natural sound can be generated.

Although the encoding mode of the scale factor of an audio signal for concealment is the offset mode in this embodiment, the encoding mode is not limited to this. For example, it is possible to determine the encoding mode of a scale factor of an audio signal for concealment for the left channel to be the inter-quantization unit prediction mode and the encoding mode of a scale factor of an audio signal for concealment for the right channel to be the inter-channel prediction mode.

However, it is desirable not to set the inter-frame prediction mode as the encoding mode of the scale factor of an audio signal for concealment. When the inter-frame prediction mode is not set, the amount of processing of the error concealment process can be reduced and accordingly the amount of data to be stored in a storage region of the encoding apparatus 30 can be reduced.

In addition, the encoding mode of a scale factor may be set for each frame.

Furthermore, although the above-described encoded data includes an encoded scale factor, information regarding normalization included in the encoded data is not necessarily an encoded scale factor and may be a coefficient used for the normalization or a scale factor itself.

Description of Computer to Which Present Disclosure is Applied

Now, the above-described series of processes may be performed by hardware or software. If the series of process is performed by software, a program included in the software is installed on a general-purpose computer or the like.

Figure 11:
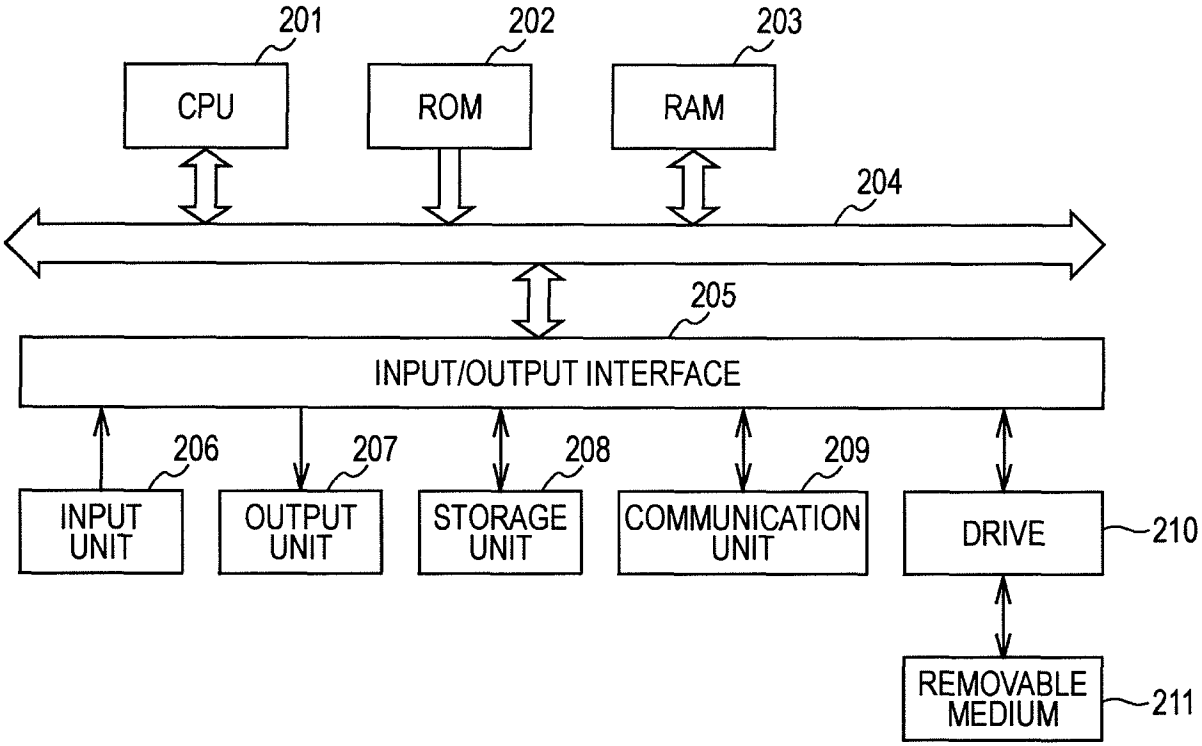
FIG. 11 is a block diagram illustrating an example of the configuration of a computer according to an embodiment.

FIG. 11 illustrates an example of the configuration of a computer according to an embodiment on which a program that executes the above-described series of processes is installed.

The program may be recorded on a storage unit 208 or a read-only memory (ROM) 202 in advance, which is a recoding medium incorporated into the computer.

Alternatively, the program may be stored in (recorded on) a removable medium 211. Such a removable medium may be provided as so-called package software. Here, the removable medium 211 may be, for example, a flexible disk, a compact disc read-only memory (CD-ROM), a magneto-optical (MO) disk, a digital versatile disc (DVD), a magnetic disk, a semiconductor memory, or the like.

The program may be installed not only on the computer through a drive 210 from the above-described removable medium 211 but also on the storage unit 208 incorporated into the computer by downloading the program to the computer through a communication network or a broadcast network. That is, the program may be, for example, wirelessly transferred from a download website to the computer through an artificial satellite for digital satellite broadcast or transferred to the computer through a cable network such as a local area network (LAN) or the Internet.

The computer includes a central processing unit (CPU) 201. An input/output interface 205 is connected to the CPU 201 through a bus 204.

When a command is input to the CPU 201 through the input/output interface 205 by, for example, a user who operates an input unit 206, the CPU 201 executes the program stored in the ROM 202. Alternatively, the CPU 201 loads the program stored in the storage unit 208 into the random-access memory (RAM) 203 and executes the program.

The CPU 201 thus performs the processes according to the above-described flowcharts or the process according to the configuration illustrated in the above-described block diagrams. The CPU 201 then, for example, outputs results of the processes from an output unit 207, transmits results of the processes from a communication unit 209, or records results of the processes on the storage unit 208, through the input/output interface 205 as necessary.

The input unit 206 is configured by a keyboard, a mouse, a microphone, or the like. The output unit 207 is configured by a liquid crystal display (LCD), a speaker, or the like.

The processes performed by the computer in accordance with the program are not necessarily performed chronologically in the order described in the flowcharts herein. That is, the processes performed by the computer in accordance with the program include processes executed in parallel with one another or individually (for example, parallel processes or processes executed using an object).

In addition, the program may be processed by a single computer (processor) or may be subjected to distributed processing performed by a plurality of computers. Furthermore, the program may be transferred to a distant computer and executed.

Embodiments of the present disclosure are not limited to the above-described embodiments and may be modified in various ways insofar as the scope of the present disclosure is not deviated from.

The present disclosure contains subject matter related to that disclosed in Japanese Priority Patent Application JP 2010-270544 filed in the Japan Patent Office on Dec. 3, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An encoding apparatus comprising:

a time-frequency transform unit that performs a time-frequency transform on an audio signal;

a normalization unit that normalizes a frequency spectral coefficient obtained by the time-frequency transform in order to generate encoded data of the audio signal;

a level calculation unit that calculates a level of the audio signal;

a scale factor changing unit that changes a concealment scale factor included in encoded concealment data obtained by performing, on the basis of the level of the audio signal, a time-frequency transform and normalization on a minute noise signal, the concealment scale factor being a scale factor relating to a coefficient used for the normalization; and an output unit that, if an error has not occurred during encoding of the audio signal, outputs the encoded data of the audio signal generated by the normalization unit, and that, if an error has occurred during the encoding of the audio signal, outputs, as encoded data of the audio signal, the encoded concealment data whose concealment scale factor has been changed.

2. The encoding apparatus according to claim 1, wherein the level calculation unit calculates an average value, a maximum value or a minimum value of an original scale factor, which is a scale factor relating to a coefficient used for normalization performed by the normalization unit on the audio signal, as the level of the audio signal.

3. The encoding apparatus according to claim 1, wherein the concealment scale factor is encoded into a certain offset value and a difference between the certain offset value and the concealment scale factor, and wherein the scale factor changing unit changes the concealment scale factor by changing the certain offset value.

4. The encoding apparatus according to claim 1, further comprising:

a scale factor encoding unit that performs inter-frame prediction encoding on an original scale factor, which is a scale factor relating to a coefficient used for the normalization performed by the normalization unit on the audio signal and holds the original scale factor, wherein the scale factor changing unit causes, if an error has occurred during the encoding of the audio signal, the normalization unit to hold the concealment scale factor that has been subjected to a change made by the scale factor changing unit as an original scale factor of the audio signal, and wherein the scale factor encoding unit performs inter-frame prediction encoding on the original scale factor using the original scale factor held by the scale factor encoding unit.

5. The encoding apparatus according to claim 1, wherein the number of bits of the encoded concealment data is a smallest number of bits that can be processed by the encoding apparatus, and wherein the output unit performs padding on the encoded concealment data such that the number of bits of the encoded concealment data corresponds to an output bit rate, and outputs the encoded concealment data.

6. An encoding method comprising:

causing an encoding apparatus to perform a time-frequency transform on an audio signal;

normalize a frequency spectral coefficient obtained by the time-frequency transform in order to generate encoded data of the audio signal;

calculate a level of the audio signal;

change a concealment scale factor included in encoded concealment data obtained by performing, on the basis of the level of the audio signal, a time-frequency transform and normalization on a minute noise signal, the concealment scale factor being a scale factor relating to a coefficient used for the normalization; and output, if an error has not occurred during encoding of the audio signal, the encoded data of the audio signal generated by the normalization, and output, if an error has occurred during the encoding of the audio signal, the encoded concealment data whose concealment scale factor has been changed as encoded data of the audio signal.

7. A non-transitory computer-readable medium having embodied thereon a program, which when executed by a computer causes the computer to execute a process including:

performing a time-frequency transform on an audio signal;

normalizing a frequency spectral coefficient obtained by the time-frequency transform in order to generate encoded data of the audio signal;

calculating a level of the audio signal;

changing a concealment scale factor included in encoded concealment data obtained by performing, on the basis of the level of the audio signal, a time-frequency transform and normalization on a minute noise signal, the concealment scale factor being a scale factor relating to a coefficient used for the normalization; and outputting, if an error has not occurred during encoding of the audio signal, the encoded data of the audio signal generated by the normalization, and outputting, if an error has occurred during the encoding of the audio signal, the encoded concealment data whose concealment scale factor has been changed as encoded data of the audio signal.

8. A decoding apparatus comprising:

an inverse normalization unit that performs inverse normalization on encoded data using a scale factor of the encoded data included in the encoded data supplied from an encoding apparatus that, if an error has not occurred during encoding of an audio signal, outputs the encoded data generated by performing a time-frequency transform and normalization on the audio signal, and that, if an error has occurred during the encoding of the audio signal, changes, on the basis of a level of the audio signal, a concealment scale factor included in encoded concealment data obtained by performing a time-frequency transform and normalization on a minute noise signal, the concealment scale factor being a scale factor relating to a coefficient used for the normalization, and then outputs the encoded concealment data as the encoded data of the audio signal; and a frequency-time transform unit that performs a frequency-time transform on a frequency spectrum obtained as a result of the inverse normalization performed by the inverse normalization unit.

9. The decoding apparatus according to claim 8, further comprising:

a judgment unit that judges whether or not the encoded data is the encoded concealment data by comparing the encoded data and encoded concealment data for comparison, which is the encoded concealment data before the concealment scale factor is changed.

10. The decoding apparatus according to claim 9, wherein the judgment unit compares first data, which is data included in the encoded data other than the scale factor, and second data, which is data included in the encoded concealment data for comparison other than the concealment scale factor, and, if the first data and the second data match, judges that the encoded data is the encoded concealment data.

11. The decoding apparatus according to claim 9, further comprising:

a generation unit that, if the judgment unit has judged that the encoded data is the encoded concealment data, generates an audio signal for concealment using the concealment scale factor included in the encoded concealment data and encoded data older than the encoded concealment data, wherein, if the judgment unit has judged that the encoded data is not the encoded concealment data, the inverse normalization unit performs inverse normalization on the encoded data.

12. The decoding apparatus according to claim 8, wherein the concealment scale factor is encoded into a certain offset value and a difference between the certain offset value and the concealment scale factor.

13. The decoding apparatus according to claim 8, further comprising:

a scale factor decoding unit that performs inter-frame prediction decoding on the scale factor of the encoded data that is not the encoded concealment data and holds a scale factor obtained as a result of the decoding, wherein the scale factor decoding unit holds the concealment scale factor as the scale factor obtained as a result of the decoding and performs inter-frame prediction decoding using the scale factor held by the scale factor decoding unit.

14. The decoding apparatus according to claim 8, further comprising:

an extraction unit that extracts the encoded concealment data from encoded concealment data that has been subjected to padding and that is supplied from the encoding apparatus.

15. A decoding method comprising:

causing a decoding apparatus to perform inverse normalization on encoded data using a scale factor of the encoded data included in the encoded data supplied from an encoding apparatus that, if an error has not occurred during encoding of an audio signal, outputs the encoded data generated by performing a time-frequency transform and normalization on the audio signal, and that, if an error has occurred during the encoding of the audio signal, changes, on the basis of a level of the audio signal, a concealment scale factor included in encoded concealment data obtained by performing a time-frequency transform and normalization on a minute noise signal, the concealment scale factor being a scale factor relating to a coefficient used for the normalization, and then outputs the encoded concealment data as the encoded data of the audio signal; and perform a frequency-time transform on a frequency spectrum obtained as a result of the inverse normalization.

16. A non-transitory computer-readable medium having embodied thereon a program, which when executed by a computer causes the computer to execute a process including:

performing inverse normalization on encoded data using a scale factor of the encoded data included in the encoded data supplied from an encoding apparatus that, if an error has not occurred during encoding of an audio signal, outputs the encoded data generated by performing a time-frequency transform and normalization on the audio signal, and that, if an error has occurred during the encoding of the audio signal, changes, on the basis of a level of the audio signal, a concealment scale factor included in encoded concealment data obtained by performing a time-frequency transform and normalization on a minute noise signal, the concealment scale factor being a scale factor relating to a coefficient used for the normalization, and then outputs the encoded concealment data as the encoded data of the audio signal; and performing a frequency-time transform on a frequency spectrum obtained as a result of the inverse normalization.

* * * * *